United States Patent [19]

Janeway, III et al.

[11] 4,319,829

[45] Mar. 16, 1982

[54] NONCIRCULAR PHOTOCONDUCTOR BELT MOUNTING APPARATUS AND METHOD

[75] Inventors: Donald L. Janeway, III, Broomfield; Peter A. Stevenson, Boulder, both of Colo.

[73] Assignee: International Business Machines Corporation, Armonk, N.Y.

[21] Appl. No.: 173,590

[22] Filed: Jul. 30, 1980

[51] Int. Cl.[3] ..... G03G 15/00

[52] U.S. Cl. ..... 355/3 BE; 355/3 R; 355/16; 355/3 DR; 118/651

[58] Field of Search ..... 355/3 R, 3 BE, 14 R, 355/, 16, 3 DR; 118/651

[56] References Cited

U.S. PATENT DOCUMENTS

| | | | |
|---|---|---|---|
| 3,435,693 | 4/1969 | Wright et al. | 74/241 |
| 3,697,160 | 10/1972 | Clark | 355/3 |
| 3,722,992 | 3/1973 | Zweig | 355/16 X |
| 4,013,359 | 3/1977 | DuBois et al. | 355/16 |
| 4,025,188 | 5/1977 | Radle, Jr. et al. | 355/16 |
| 4,063,809 | 12/1977 | Schrempp et al. | 355/16 X |
| 4,155,639 | 5/1979 | Bejerano et al. | 355/3 BE |
| 4,189,223 | 2/1980 | Silverberg | 355/3 BE |

OTHER PUBLICATIONS

IBM Technical Disclosure Bulletin, vol. 9, No. 11, Apr. 1967, pp. 1526–1527, entitled "An Electrographic Printer with Asynchronous Image Belt", by Hider et al.

*Primary Examiner*—Arthur C. Prescott
*Attorney, Agent, or Firm*—Earl C. Hancock

[57] ABSTRACT

A flexible, closed loop belt having a photoconductive surface is mounted internally to a xerographic-type copier. The belt mounting frame or guide, is arranged to include a series of interconnected courses defining a supporting path for the belt. One or more portions of the guide surface are formed as peripheral segments of a cylinder. Various courses are interconnected in a generally continuous closed loop path for the belt.

9 Claims, 4 Drawing Figures

NONCIRCULAR PHOTOCONDUCTOR BELT MOUNTING APPARATUS AND METHOD

CROSS-REFERENCE TO RELATED APPLICATION

Application Ser. No. 107,217, filed Dec. 26, 1979 for "Component Mounting Apparatus Useful For Compact Copiers", by Ernst, McCollum, Queener, and Wilzbach, which is assigned to the same assignee as this application, shows in FIGS. 7 and 8 an efficient arrangement for locating various components associated with a compact copier internally to a belt mounting structure, similar to the belt mounting structure of this application.

TECHNICAL FIELD

The present invention relates to methods and apparatus for mounting flexible photoconductor belts within a compact copier machine. More particularly, the present invention relates to methods and apparatus for mounting closed loop, flexible belts having photoconductor surfaces thereon so that they retain their proper relationship to the various elements associated with the copying process of the machine. Photoconductor belt mounts constructed in accordance with this invention make it possible to realize maximum efficiency of internal space utilization within the copier. The present invention is particularly well-suited for supporting xerographic copier operations relative to processing elements designed and fabricated for interfacing with photoconductor drums in a manner that avoids the volumetric size of the overall copier demanded by a full size photoconductor drum.

BACKGROUND ART

A substantial number of the contemporary xerographic office copiers and the like have developed around the use of a cylindrical drum having a photoconductive surface thereon. The xerographic processing elements associated with such drums have developed to a relatively high degree of sophistication and reliability, but in many cases, in configurations which require the processing elements to interface with the peripheral surface of the photoconductor drum. Typical processing elements so configured include developers, paper path guiding arrangements, transfer apparatus, coronas, and so forth. Unfortunately, cylindrical drums, to retain the complete original document image, must be of such a diameter that they dictate the minimum size that an office copier can assume. Furthermore, the drum mounting structure requires relatively close tolerances to minimize variations in the drum photoconductive surface orientation, relative to the processing elements, as the drum rotates.

Although many contemporary copiers incorporate drum-type photoconductors, the use of flexible belts having a photoconductive external surface for the copying process has been known for many years. Sometimes these flexible belts have been used for accommodation of multiple images concurrently present on the photoconductor belt, such as is shown in the April 1967 IBM TECHNICAL DISCLOSURE BULLETIN (Vol. 9, No. 11) at pages 1526–1527 in the article entitled "An Electrographic Printer With Asynchronous Image Belt", by Hider and Medley. Other prior art flexible belt copiers have been employed for the purpose of positioning the photoconductive belt so that a flat portion thereof is located in a manner that will allow imaging of an entire document at one time, as is shown in U.S. Pat. No. 3,435,693 by Wright et al. wherein three rollers are employed to retain the flexible photoconductor belt in position, and U.S. Pat. No. 3,697,160 by Clark wherein two rollers provide the same function.

None of the known prior art flexible belt copiers have suggested configuring the belt mounts so as to accommodate the interface of processing elements designed and proven for use with cylindrical drums. Furthermore, none of the known prior art belt type copiers use an arrangement of the belt, its mount and the associated processing elements for maximum utilization of internal machine space in a manner that allows the most compact overall copier configuration.

DISCLOSURE OF INVENTION

Compact copier machines in accordance with the present invention make it possible to most efficiently utilize the space within the machine housing in which a flexible, closed loop belt, having a photoconductor surface, is to be mounted. This photoconductor belt is to be used in conjunction with a xerographic process or the like, and the machine will utilize at least one element configured with an interface for operatively cooperating with a photoconductively surfaced drum having a radius R, where such a drum has a circumferential length adequate to receive the image of an original document or the like. Apparatus in accordance with this invention for noncylindrically mounting the belt include a guide which has a plurality of outwardly facing surfaces forming a series of interconnected courses for supportingly engaging the interior surface of the belt in a closed loop path. At least one of the surfaces of this guide is configured for defining a course in the form of a segment of the periphery of a cylinder of a radius R, with the adjacent courses being configured with other than the radius R. The guide means is attached relative to the machine housing so as to locate the cylinder segment surface in facing relation to the machine element interface formed with the radius R. Therefore, the belt is advantageously maintained in a fixed space relation to the processing element interface, a result not always possible with a rotating photoconductor drum.

The guide for the flexible belt can include multiple courses having the radius R for interfacing with respective elements, although it should be noted that different radii for different belt supporting segments can be employed if desired, to interface with xerographic processing components designed and proven in a manner so as to conform to photoconductive drums having different radii.

Another feature of the present invention is that the photoconductive belt can be positioned across a generally straight portion of the guide with a motivating device for the belt, such as a roller drive or the like, on the downstream side of the straight portion, and a means for applying tension to the belt on the upstream side so that the belt remains relatively straight across the straight portion. This allows reliable projection of the image to be copied onto the belt in that straight portion as by scanning and/or full document imaging.

The present invention is equally suitable for use with any of a variety of imaging devices such as fiber optic scanners, moving mirror and/or lense scanners, flash scanners, film or microfiche projectors, and so forth.

The foregoing and other objects, features, advantages, and applications of the present invention will be readily apparent to those having normal skill in the art from the following more detailed description of the exemplary preferred embodiment, as illustrated in the accompanying drawings.

DETAILED DESCRIPTION OF THE PREFERRED EMBODIMENT

The exemplary preferred embodiment as shown and described in detail hereinafter is presented in the environment of a so-called two-cycle copier of compact configuration. It will be readily understood by those having normal skill in the art, that the present invention is equally adaptable for use in other machine environments.

Figure 1:
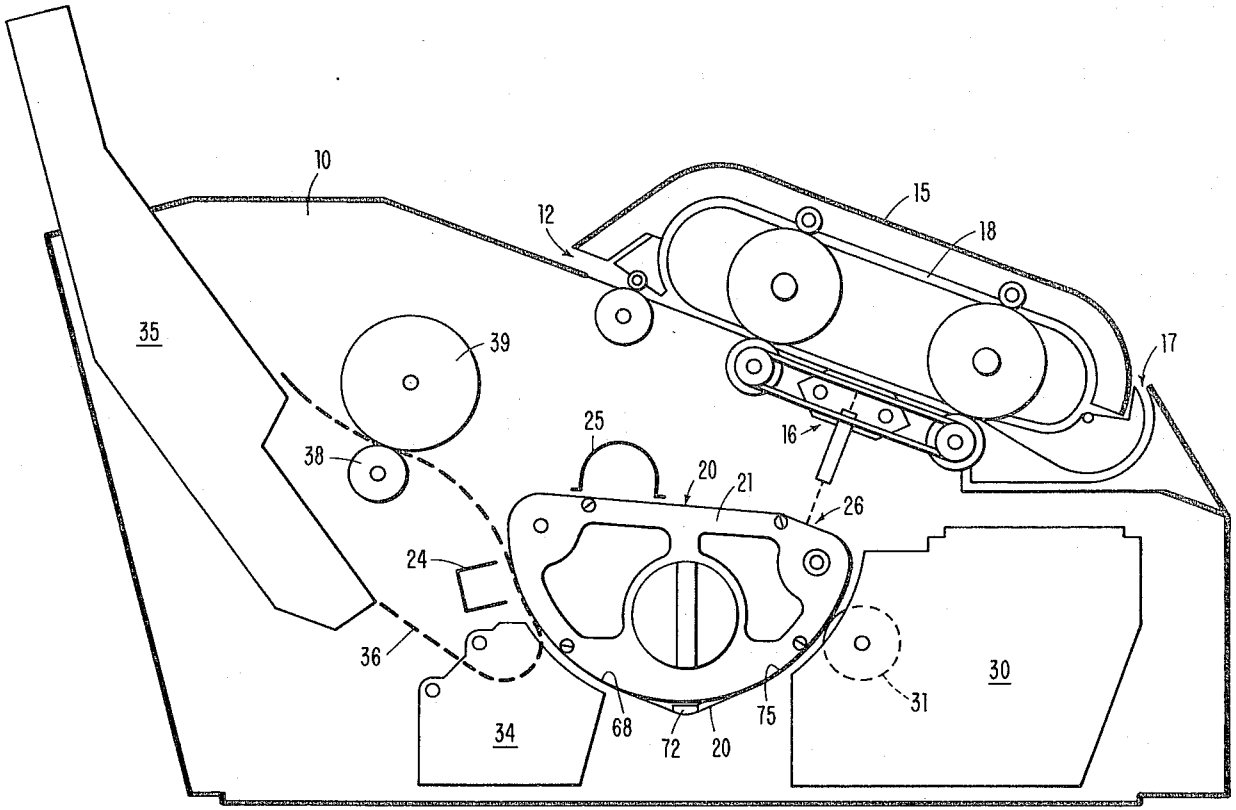
FIG. 1 is a side view of a copier in somewhat schematic form, illustrating the interrelationship of a belt-mount arrangement to the copier elements.

In FIG. 1, copier 10 receives documents to be copied through input slot 12, where they are driven by the document feeder 15 past a fiber optic scanning station 16. The original documents, after processing, are either delivered to the exit slot 17, or are recirculated for multiple copies as by return paper path 18. The image of the original document thus scanned is placed upon a continuous loop photoconductor (PC) belt 20, which is retained in place by means of a guide frame assembly 21, described in greater detail hereinbelow.

Copier 10 is shown in the two-cycle process configuration wherein coronas 24 and 25 initially operate as precharge and charge coronas, respectively, to place an appropriate electrostatic voltage level on PC belt 20. The image of the original document is placed upon belt 20 at scan location 26 by selective discharge, based upon the image contained in the original document as is well known. This image is then developed by developer unit 30 which places toner on appropriate areas of belt 20 as it passes the magnetic brush roller 31.

The image on belt 20 encounters paper gating mechanism 34 which controls the introduction of copy sheets from cassette 35 over the paper path shown generally at 36, to the photoconductor belt 20 in appropriate synchronism with the movement of the toned image on belt 20. Corona 24 then operates as a transfer corona to transfer toner from belt 20 onto the copy sheets. The copy sheets continue to the fuser comprised of rollers 38 and 39 where the toner image is fused to the copy sheet substrate. The toned copy sheet is then exited from the machine.

Figure 2:
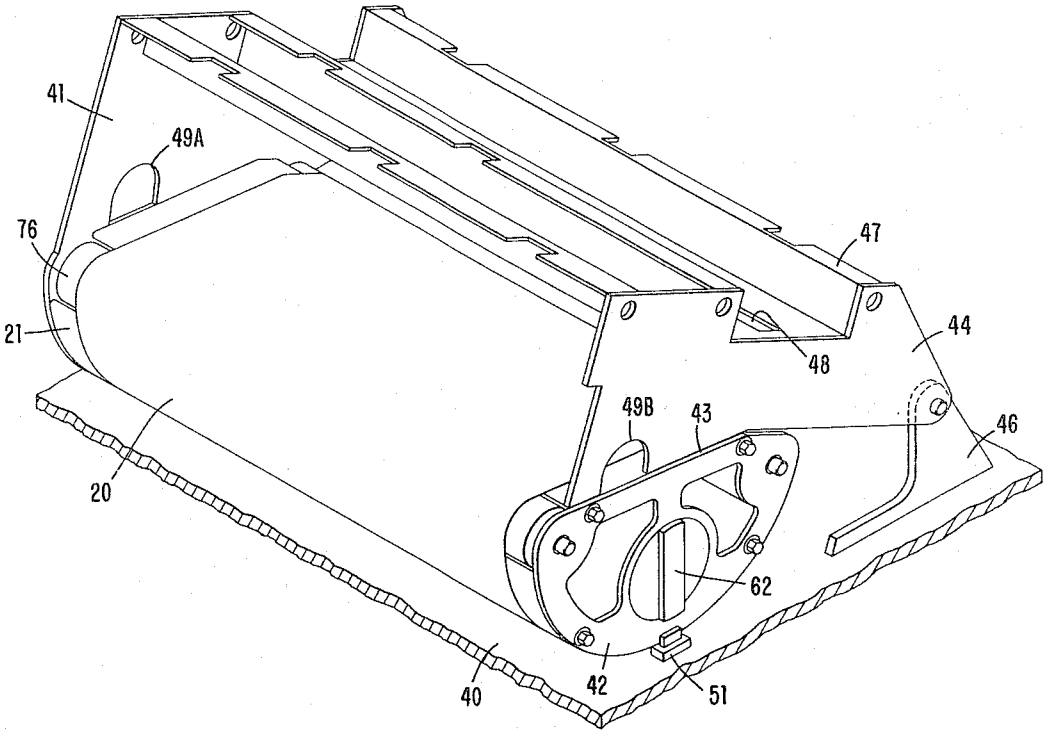
FIG. 2 is an isometric view of a belt mounting guide for the FIG. 1 embodiment, taken from one end.
Figure 3:
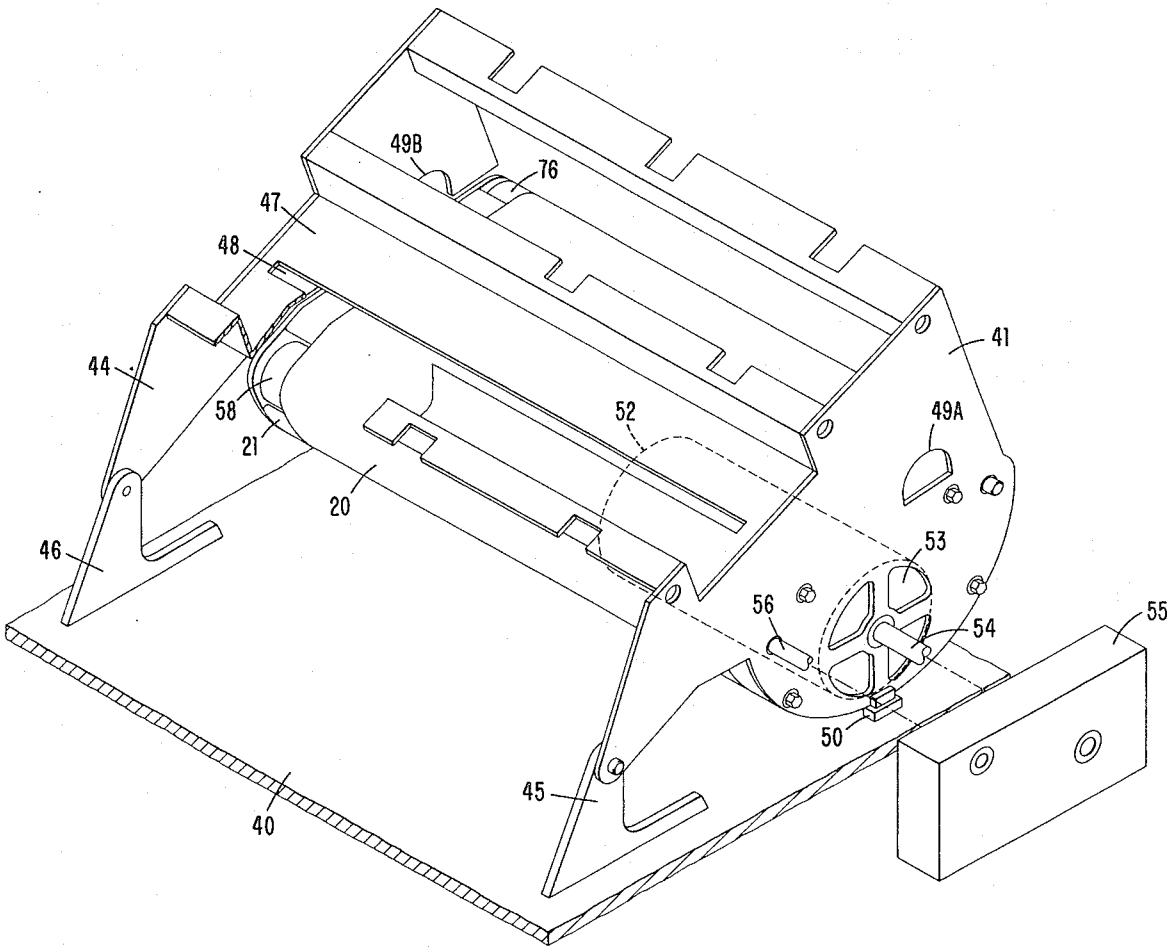
FIG. 3 is an isometric view of the mounting arrangement for the belt guide of FIGS. 1 and 2, taken from the opposite end relative to FIG. 2.

The details of the manner of mounting the belt guide frame 21 relative to the main frame 40 of copier 10, is shown in isometric views in FIGS. 2 and 3, taken from opposite directions. Although frame 40 is shown symbolically as a solid plate in FIGS. 2 and 3, it will be recognized that the machine frame is appropriately configured for permitting proper attachment and interfacing between belt guide 21 and other xerographic processing elements such as corona 24, developer 30 and paper feed mechanism 34 shown in FIG. 1. One end of frame 21 is attached to plate 41, while the other end 42 is shown detached from end plate 44. Although frame 21 is thus mounted in a cantilever relation from end plate 41, it will be understood that plate 42 can be releasably secured relative to end plate 44 by any suitable latching arrangement. Preferably, the latching mechanism should be such as to allow replacement of sleeve belt 20 on frame 21. For instance, a hook bar attached between plates 42 and 44 can be pivotable out of the way of slot 43 between plates 42 and 44 to allow belt 20 to be replaced. Plates 41 and 44 are pivotally attached to respective mounting brackets 45 and 46 which are, in turn, secured to machine frame 40.

Cross-member 47 includes a slot 48 to accommodate the fiber optic bundle of scanning assembly 16, not shown in FIGS. 2 and 3. Thus the entire assembly, including belt 20 and belt mounting guide 21 is pivotable relative to main frame 40 to allow access for servicing. Holes 49 in plates 41 and 44 accommodate positioning of corona 25 also not shown in FIGS. 2 and 3. When in operating position, end plates 41 and 42 rest upon stop members 50 and 51, respectively.

Motor 52 is mounted internally to belt mounting frame or guide 21 in a manner taught by the aforementioned cross-referenced application Ser. No. 107,217. Slots such as 53 allow air to flow through motor 52 through end plate 41, and drive shaft 54 is coupled into a gear or drive belt transmission 55 for imparting power to other components associated with the copier operation as needed. In addition, transmission 55 couples operating power to drive shaft 56, which is connected to rotate roller 58. Accordingly, roller 58 imparts motivating power to photoconductor belt 20, which is formed as a continuous sleeve, thereby driving belt 20 past the appropriate processing stations.

It is to be understood that belt 20 can be positively located on roller 58 and thus on frame 21 by including radially extending pins (not shown) near the outer ends of roller 58. These pins can be cammed in radial directions relative to roller 58 in and out of sprocket-type engagement with matching holes on the edge or edges of belt 20 to facilitate removal and replacement of sleeve belt 20 as needed. Belt 20 need not necessarily be positively driven as by sprocket pins or the like if appropriate synchronization is associated with the edge of belt 20, or if some other means is included in the copier for synchronizing the movement of original document images on belt 20 with the movement of copy sheets for image transfer purposes.

Figure 4:
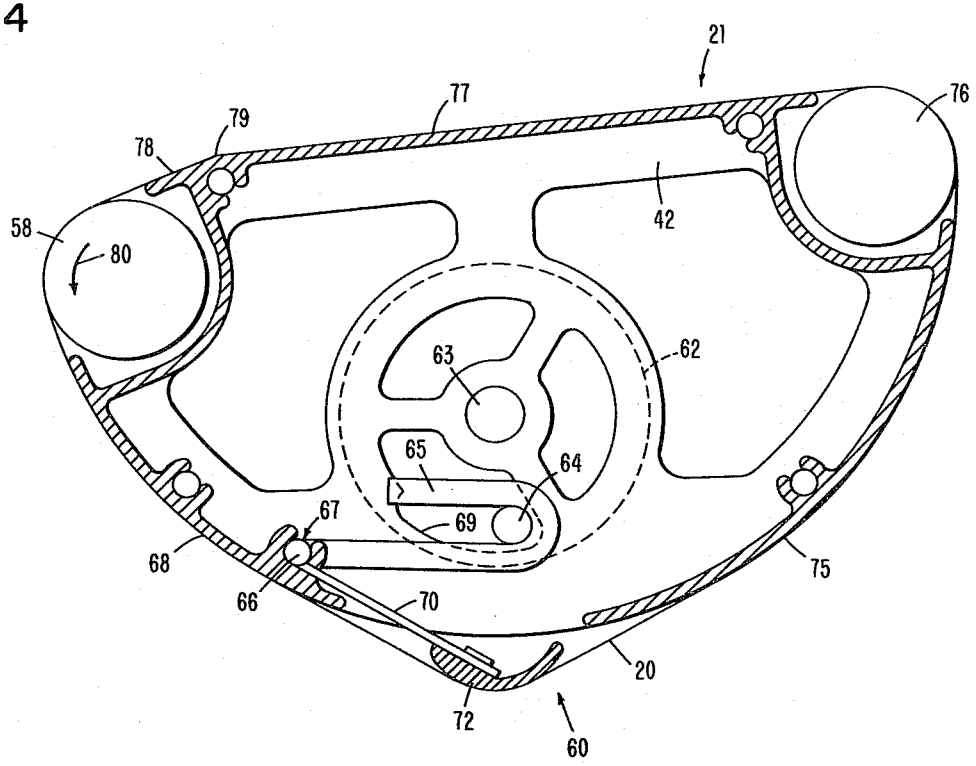
FIG. 4 is a sectioned view of the belt mounting apparatus in accordance with this invention, looking toward the belt tension applying/relieving end.

FIG. 4 presents a sectioned view of belt mounting guide 21, particularly illustrating the interrelationship of the components including the tensioning assembly 60. Knob 62 shown in FIG. 2, is mounted for rotary movement around hub 63 in end frame 42. Pin 64 on the reverse side of knob 62 extends inwardly into guide 21 so as to engage the interior of J-shaped bar 65. Bar 65 is further attached to shaft 66, which is retained in the groove 67 relative to sidewall 68.

Rotation of knob 62 in a clockwise direction, as viewed in FIG. 4, causes pin 64 to follow cam surface 69. In the position shown in FIG. 4, cantilever spring member 70 holds curved plate 72 in a outward direction, thereby applying slack-removing tension to the interior surface of belt 20. To accommodate removal and replacement of sleeve-type photoconductor belt 20, rotation of pin 64 to its clockwise position relative to cam surface 69 as shown in FIG. 4 causes shaft 66 to rotate so that spring arm 70 pivots upwardly into the interior of frame guide 21, thereby loosening belt 20 so that it may be easily slid over the surface of guide 21 and removed.

Note that belt guide 21 is essentially formed of a series of interconnected courses. That is, member 21 is formed such as by extrusion or the like, with surfaces defined by sidewalls 68 and 75 essentially defining two segments of a path having a radius R, where the radius R is for a drum which would be configured so as to appropriately interface with the elements such as developer/cleaner 30 and sheet feed mechanism 34 shown in FIG. 1. Although shown in FIG. 4 as a relatively continuous cylindrical segment as between sidewalls 68 and 75, having such a radius R, it will be readily recognized that sidewall segments 68 and 75 can be positioned closer to each other so as to further reduce the size of belt guide 21 if so desired, since a continuous transition as through the area in which tensioning device 60 is located and following the continuous radius R is not required. The presence of transition courses on either side of the course or courses of radius R, where the transition courses are formed with less than radius R, ensures the belt 20 conforms predictably to the surface of radius R course. This results in a predictably reliable interface relation between moving belt 20 and the relatively fixed processing elements.

The belt guiding courses defined by guide 21, include an idler roller 76 acting as an interface between surface 75 and a flat guide portion 77. A second essentially straight or flat portion 78 is positioned relative to the imaging area, and a bend 79 is formed at the transition between surfaces 77 and 78. Drive roller 58 completes the belt guiding courses of the closed loop. Note that bend 79, as well as idler roller 76 and tensioning shoe plate 72, tend to apply a certain amount of drag to belt 20 as it is being driven by roller 58 in the direction generally suggested by arrow 80. Thus, belt 20 is assured of a relatively flat configuration as it passes the scanning area over flat surface 78.

Any of a wide variety of apparatus and techniques can be used for the elements shown. For instance, air bearings can be included relative to any of the surfaces, including tensioner bar 72 and rollers 58 or 76. Other belt tensioning mechanisms than spring arm 70 can be used. For example, the interior surface of closed loop belt 20 can be engaged by rollers or the like in place of a friction surface of element 72. Air pressure or vacuum engagement can also be used for selectively applying tension to belt 20. It will be further noted that the radii associated with different sidewalls, such as 68 and 75, need not be the same. Thus, guide 21 can be configured along one course so as to appropriately interface with one element designed for interfacing with a drum having a first radius and, along another course, for interfacing with yet another element designed to interface with a drum of a different radius.

In use, knob 62 is pivoted so as to ensure that curved shoe 72 is withdrawn into frame 21 and a sleeve-type photoconductive belt 20 is slid through slot 43 onto frame 21 into the position generally shown in FIGS. 2 and 3. Knob 62 is then pivoted in the opposite direction so as to cause pressure to be applied to the interior surface of belt 20 in the manner shown in FIG. 4 so as to place belt 20 into a state of tensile stress. The tensioning apparatus 60 is arranged such that the belt 20 is in conformity to a segment of the periphery of a drum as it interfaces with the other xerographic processing elements such as 30 and 34 in FIG. 1. Accordingly, elements 24, 30 and 34 can be of a design originally developed for a full drum. The fixed positions of sidewalls 68 and 75 with respect to the curved interfaces of elements 24, 30, and 34 ensures that belt 20 is maintained in proper relation to these elements as it moves, thereby realizing an advantage not enjoyed by rotating drums unless precision parts and manufacturing techniques are used. Yet another significant advantage of this invention is that the total volumetric requirements associated with guide 21 are substantially reduced in contrast to a drum as is readily apparent in FIG. 1. Thus a copier can be constructed with a relatively low profile and maximum efficiency of both operation and space utilization within the covers of the copier. Belt 20 cooperates with the processing stations in a conventional manner after placement on guide 21.

Although the present invention has been described with particularity relative to the foregoing detailed description of an exemplary preferred embodiment, various modifications, changes, additions, and applications of the present invention in addition to those mentioned herein will be readily apparent to those having normal skill in the art without departing from the spirit of this invention.

What is claimed is:

1. In a machine having a housing in which is to be mounted a flexible, closed loop belt including a photoconductor for use in conjunction with a xerographic process or the like and wherein the machine includes at least one element configured with an interface for operatively cooperating with a photoconductively surfaced drum having a radius R and a circumference of a length adequate to receive the image of an original document or the like, apparatus for noncylindrically mounting the belt comprising:

guide means having a plurality of outwardly facing surfaces forming a series of interconnected courses for supportingly engaging the interior surface of the belt in a closed loop path, at least one of said surfaces being configured for defining a said course in the form of a segment of the periphery of a cylinder of said radius R with the adjacent said courses being configured with other than said radius R, and means attaching said guide means relative to the machine housing for locating said cylinder segment surface in facing relation to the machine element interface.

2. In a machine in accordance with claim 1 having a plurality of xerographic process elements, each having an interface for operatively cooperating with a photoconductively surfaced drum having said radius R, said guide means having a plurality of said cylinder segment surfaces, and said attaching means including means aligning said cylinder segment surfaces in facing relation to respective machine element interfaces.

3. Apparatus in accordance with claim 1 wherein said courses adjacent said cylinder segment are each configured with a radius less than R, whereby said belt is maintained in conformity to said cylinder segment.

4. In a machine in accordance with claim 1, said guide means including (A) a generally straight portion, (B) roller means engaging said belt on one side of said straight portion for pulling said belt across said straight portion, and (C) means on the opposite side of said straight portion for maintaining tension in said belt as it is pulled across said straight portion, and means projecting the image to be copied onto said belt in said guide means straight portion.

5. In a machine having an image projecting means and a housing in which is to be mounted a flexible, closed loop belt having a photoconductor on the external surface thereof for use in conjunction with a xerographic process or the like and wherein the machine includes at least two xerographic process related elements configured with interfaces for operatively cooperating with respective photoconductively surfaced drums having radii R1 and R2 and where said drum circumferential lengths are each greater than the longest original document image to be projected on said drum photoconductive surfaces, apparatus for non-cylindrically mounting said belt comprising:

guide means having a plurality of outwardly facing surfaces forming a series of interconnected courses for supportingly engaging the interior surface of said belt in a closed loop path, said courses including first and second portions having surfaces formed as segments of cylinders of respective R1 and R2 radii, a generally straight portion, a driven roller positioned on one side of said straight portion for pulling said belt across said straight portion, means on the other side of said straight portion for applying a retarding force to said belt to maintain tension therein across said straight portion, and means applying outward pressure on the interior of said belt for removing slack therefrom, and means mounting said guide means relative to the machine housing for locating said first and second portions with said cylinder segment surfaces thereof in facing relation to respective said interfaces of said xerographic process related elements and for locating said straight portion for exposure by said image projecting means.

6. Apparatus in accordance with claim 5 wherein said driven roller forms the belt path transition between said straight portion and said first cylindrically surfaced portion, said outward pressure applying means forms the belt path transition between said first and second cylindrically surfaced portions, said guide means including a belt path completing assembly between said second cylindrically surfaced portion and said retarding force applying means.

7. Apparatus in accordance with claim 6 wherein said belt path completing assembly includes a second generally straight portion positioned in angular relation to the first mentioned said straight portion whereby said retarding force applying means is formed by a bend between said straight portions, said assembly further including a rotatably mounted roller located for providing the belt path transition between said second cylindrically surfaced portion and said second generally straight portion.

8. The method of mounting a flexible, closed loop belt having a photoconductive external surface in a copier machine having an original document scanning station and at least one xerographic processing element configured with an interface for operatively cooperating with a photoconductively surfaced drum having a radius R and a circumference of a length for receiving the image of an original document at said scanning station, comprising the steps of:

retaining the belt in the form of a segment of a cylinder with said radius R in operable relationship with said interface of said xerographic processing element, stretching a portion of said belt into a generally flat orientation in position for receiving images from said scanning station, completing the belt path between the locations of said retaining step and said stretching step, and continuously moving the belt around its closed loop path.

9. The method in accordance with claim 8 including the step of applying outward pressure to the inner surface of the belt for tensioning said belt.

* * * * *